United States Patent [19]

Nitta

[11] Patent Number: 4,919,610

[45] Date of Patent: Apr. 24, 1990

[54] GAS LIGHTER

[75] Inventor: Tomio Nitta, Yokohama, Japan

[73] Assignee: Tokai Corporation, Yokohama, Japan

[21] Appl. No.: 285,456

[22] Filed: Dec. 16, 1988

[30] Foreign Application Priority Data

Dec. 28, 1987 [JP] Japan ..... 62-197399[U]

[51] Int. Cl.[5] ..... F23Q 1/02

[52] U.S. Cl. ..... 431/274; 431/277

[58] Field of Search ..... 431/274, 277, 276, 273

[56] References Cited

U.S. PATENT DOCUMENTS 3,287,939 11/1966 Zellweger et al. ..... 431/277 X

FOREIGN PATENT DOCUMENTS 2715961 10/1977 Fed. Rep. of Germany ..... 431/277

*Primary Examiner*—Randall L. Green

*Attorney, Agent, or Firm*—Armstrong, Nikaido, Marmelstein, Kubovcik & Murray

[57] ABSTRACT

Disclosed is an improvement of gas lighter of the type which comprises a main body having a gas well, a gas-ejection nozzle fixed to the ceiling of the gas well, a cap operatively connected to the gas-ejection nozzle, and a fire-striking unit having a rotatable file and an associated flint. Such a gas lighter is improved in that the fire-striking unit has a connecting pipe under its bottom surface, the pipe communicating with the gas-ejection nozzle at its rear end and being open at its top end in the vicinity of the rotatable file. The building-in of the connecting pipe on the lower surface of the fire-striking unit permits reduction of the number of parts to be handled in the assembling line.

1 Claim, 2 Drawing Sheets

GAS LIGHTER

BACKGROUND OF THE INVENTION

1. Field of the Invention

The present invention relates to a gas lighter.

2. Related Art

In general, many small parts are assembled into a gas lighter.

As for a gas lighter of the type which uses a fire-striking unit with a rotatable file adapted to rotate in a horizontal plane, the gas ejection nozzle is located apart from the flame opening, and therefore a pipe is used to connect the ejection nozzle to the flame opening. The pipe is a separate, independent part, requiring one extra assembling step. The work of building a pipe into the assembled structure requires skillfulness. For these reasons the building-in of this small part in the gas lighter structure is one cause for making it difficult to perform assembling work continuously with an increased efficiency.

In view of this one object of the present invention is to provide an improved gas lighter of the type which uses a fire-striking unit with a rotatable file adapted to rotate in a horizontal plane, permitting necessary assembling work to be continuously efficiently performed by reducing the number of parts to be manually built in, and accordingly simplifying the assembling line.

SUMMARY OF THE INVENTION

To attain the object of the present invention a gas lighter of the type which comprises a main body having a gas well, a gas-ejection nozzle fixed to the ceiling of the gas well, and a cap operatively connected to the gas-ejection nozzle; and a fire-striking unit fixed to the top of the main body and having a rotatable file adapted to rotate in a horizontal plane, is improved according to the present invention in that the fire-striking unit has a pipe under its bottom surface, the pipe communicating with the gas-ejection nozzle at its rear end and being open at its top end in the vicinity of the rotatable file.

With this arrangement the pipe will be automatically put in connection to the gas-ejection nozzle simply by fitting the fire-striking unit in the top space of the main body.

Other objects and advantages of the present invention will be understood from the following description of a gas lighter according to one embodiment of the present invention, which is shown in the accompanying drawings:

PREFERRED EMBODIMENT OF THE INVENTION

Figure 1:
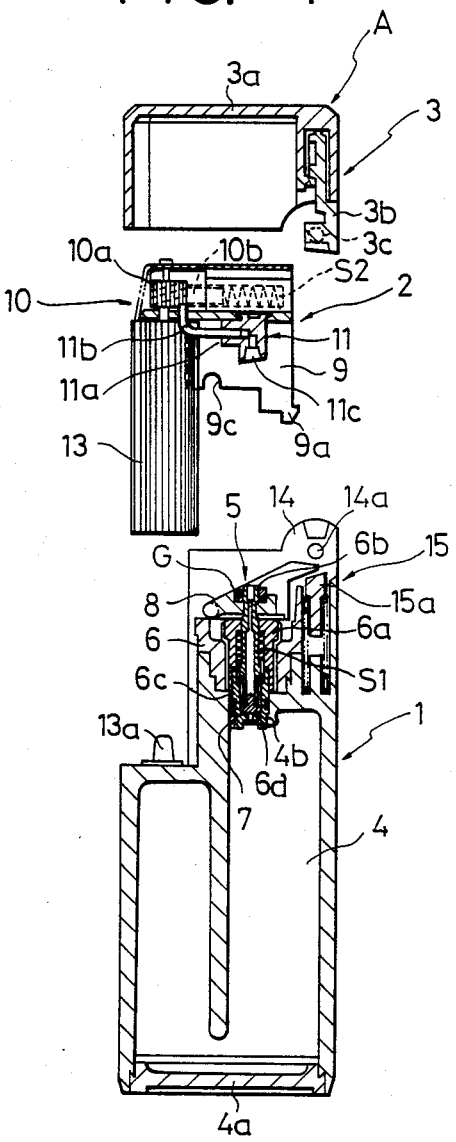
FIG. 1 is an exploded longitudinal section of a lighter according to one embodiment of the present invention.
Figure 2:
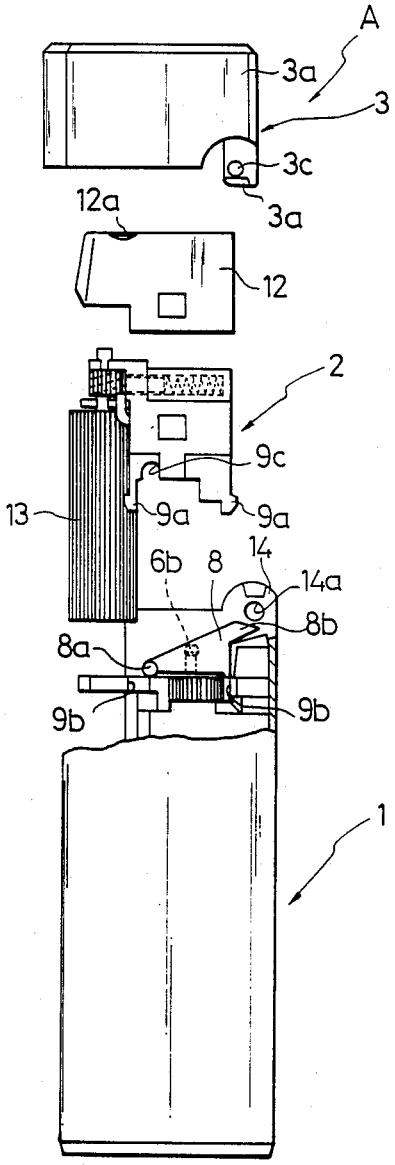
FIG. 2 is an exploded side view of the gas lighter.
Figure 3:
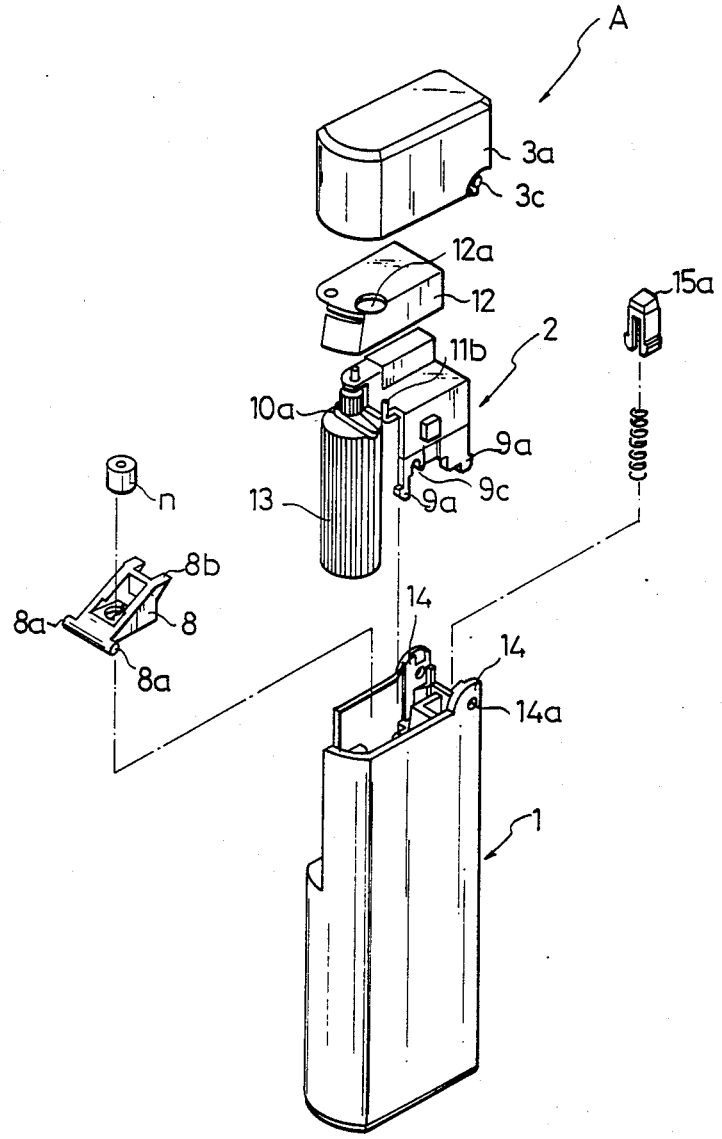
FIG. 3 is a perspective exploded view of the gas lighter.

In the drawings "A" indicates a gas lighter of the type which comprises a main body 1, a fire-striking unit 2 having a rotatable file 10*a* adapted to rotate in a horizontal plane and a cap 3. The main body is made of plastics, and has a gas well 4. A gas-ejection valve means having a vertical gas-ejection nozzle 5 is fixed to the ceiling of the gas well, and the cap 3 operatively connected to the gas-ejection nozzle 5. The fire-striking unit 2 is fixed to the top of the main body 1.

The main body 1 has a bottom closure 4*a*. A top closure 6 has an opening in alignment with the opening 4*b* of the ceiling of the gas well 4, and the lower part of the gas ejection nozzle 5 is inserted in these aligned openings. The gas-ejection nozzle 5 is composed of an outer hollow cylinder 6*a* threadedly engaged with the top closure 6, a gas-ejection pipe 6*b* vertically movably fitted in the outer hollow cylinder 6*a* with its tip end projecting from the upper surface of the outer hollow cylinder 6*a*, and an inner hollow cylinder 6*c* inserted at its top end in the bottom of the outer hollow cylinder 6*a* and at its bottom end in the opening 4*b* of the ceiling of the gas well 4.

The gas-ejection pipe 6*b* is biased by a spring S1 down to the lower position in which its movable rubber 7 closes the aperture 6*d* of the inner hollow cylinder 6*c*.

An operating lever 8 is fixed to the tip end of the gas-ejection pipe 6*b* via a rubber ring G. The operating lever 8 has opposite pivot projections 8*a* at its front end, and opposite catch extensions 8*b* at its rear end.

The fire-striking unit 2 is composed of a holder 9, a fire-striking mechanism 10 and a separate connecting pipe assembly 11. The holder 9 is made of plastics, and has a "U"-shaped section with catch hooks 9*a* integrally connected to its bottom corners. The holder 9 can be fixed to the main body 1 with its catch hooks 9*a* caught by the catch slots 9*b* of the top closure 6.

As shown, the holder 9 has opposite reentrances 9*c* made at its lower front, and when the fire-striking unit 2 is fixed to the main body 1, the opposite pivot projections 8*a* of the operating lever 8 are snugly accommodated in these reentrances 9*c* of the holder 9, thereby permitting the operating lever 8 to rotate a little about its pivot 8*a* for raising the gas-ejection pipe 6*b* when the cap 3 is opened.

An inner cap 12 is made of metal, and it has a flame opening 12*a* with the connecting pipe assembly 11 adjacent its lower surface.

The connecting pipe assembly 11 is composed of an "L"-shaped pipe 11*b* and an "L"-shaped connector 11*a*. The "L"-shaped connector 11*a* has a through channel 11*c* opening at its opposite ends. The pipe 11*b* is inserted into the upper outlet of the channel with its one leg upright. The connector 11*a* is fixed to the lower surface of the bottom of the fire-striking unit 2. Thus, when the holder 9 is fixed to the main body 1, the connector 11*a* will be set on the gas-ejection pipe 6*b*. Then, it is fitted in the lower inlet of the channel 11*c* of the connector 11*a*. At the same time, the free end of the pipe 11*b* is put in the vicinity of the fire-striking unit 10. This particular way of fixing a pipe to the underside of the fire-striking unit in the holder should not be understood as being limitative. It is important that the pipe is fixed to the underside of the fire-striking unit in holder in right position, no matter how the pipe is fixed to the underside of the fire-striking unit. The pipe can be fixed to the fire-striking unit in different ways.

The fire-striking machanism 10 comprises a rotatable file 10*a* and a flint 10*b*. The file 10*a* is located adjacent to the flame opening 12*a*, and is adapted to rotate in a horizontal plane. The flint 10*b* is pushed against the file by spring S2.

The rotatable file 10*a* is connected coaxially to a rotary cylinder 13, which is to be rotatably fixed to the main body 1. When the rotary cylinder 13 is rotated, the gas ejected from the connecting pipe assembly 11 is ignited.

The fire-striking unit 2 can be integrally combined with the main body 1 by pushing and fitting the fire-striking unit 2 in the main body 1 to permit the catch hooks 9*a* of the holder 9 to be caught by the catch slots 9*b* of the top closure 6, and then the rotary cylinder 13 is put on the shoulder of the main body 1 with its projection 13*a* inserted in the center counter hole of the rotary cylinder 13.

When the fire-striking unit 2 is integrally combined with the main body 1, the connecting pipe assembly 11 is put in connection to the gas-ejection nozzle 5.

The cap 3 comprises a metal enclosure 3*a* to cover the fire-striking unit 2, and a support piece 3*b*, which is inserted into the rear slot of the metal encloure 3*a*. The support piece 3*b* has pivots 3*c* projecting from its opposite sides. These pivots 3*c* are inserted in the holes 14*a* which are made on the opposite rear upper extentions 14 of the main body 1. Thus, the cap 3 is rotatably fixed to the main body 1 with its support piece 3*b* abutting on a lock 15 and a spring-biased push pin 15*a*. The cap 3 can be rotated about its pivot 3*c* between opening and closing positions.

As shown, the support piece 3*b* has a recessed portion 3*d*. The rear extension 8*b* of the operating lever 8 is caught by the recessed portion 3*d* of the support piece, and therefore the operating lever 8 is rotated to raise the gas-ejection pipe 6*b* for ejection of gas when the cap 3 is opened.

As may be understood from the above, the building-in of the connecting pipe assembly on the lower surface of the bottom of the fire-striking unit permits reduction of the number of parts to be manually handled in the assembling line, and accordingly simplifying the assembling work and increasing the efficiency with which necessary parts are assembled.

This contributes to the increase of continuity in the automatic assembling work by eliminating the necessity of manualy handling a selected part, and accordingly reduction of manufacturing cost.

What is claimed is:

1. A gas lighter comprising a main body having a gas well, a gas-ejection valve means fixed to the ceiling of the gas well and including a vertical gas-ejection nozzle, a cap operatively connected to the gas-ejection nozzle to open and close the valve means, a fire-striking unit fixed to the top of the main body and having a rotatable file adapted to rotate in a horizontal plane, and a separate connecting pipe assembly fixed to an underside of the fire-striking unit and including a pipe having a rear end and a top end, the pipe being fitted onto and communicating with the gas-ejection nozzle at its rear end and being open at its top end in the vicinity of the rotatable file.

* * * * *